United States Patent [19]

Stewart et al.

[11] Patent Number: 4,599,048

[45] Date of Patent: Jul. 8, 1986

[54] INDUSTRIAL SUCTION APPARATUS

[76] Inventors: Robert C. Stewart, 'Lundy', Sauchen, Aberdeenshire; Colin O. Hart, 17 Eastburn Road, Kintore, both of Scotland

[21] Appl. No.: 722,192

[22] Filed: Apr. 11, 1985

Related U.S. Application Data

[63] Continuation of Ser. No. 488,464, Apr. 25, 1983, abandoned.

[30] Foreign Application Priority Data

Oct. 27, 1982 [GB] United Kingdom ..... 8230673

[51] Int. Cl.[4] ..... F01B 25/02

[52] U.S. Cl. ..... 417/85; 417/149

[58] Field of Search ..... 417/148, 149, 38, 395, 417/85, 46, 47

[56] References Cited

U.S. PATENT DOCUMENTS

| | | | |
|---|---|---|---|
| 862,867 | 8/1907 | Eggleston | 417/390 |
| 1,042,980 | 10/1912 | Shawver | 417/46 |
| 1,945,973 | 2/1934 | Graham | 417/148 X |
| 2,141,427 | 12/1938 | Bryant | 417/148 X |
| 3,319,578 | 5/1967 | Ware | 417/148 |
| 3,342,135 | 9/1967 | Schnabel, Jr. | 417/38 |
| 4,319,570 | 3/1982 | Grane | 417/395 |
| 4,339,232 | 7/1982 | Campbell | 417/148 X |

FOREIGN PATENT DOCUMENTS

| | | | |
|---|---|---|---|
| 2011547 | 7/1979 | United Kingdom | 417/148 |
| 626251 | 9/1978 | U.S.S.R. | 417/148 |

*Primary Examiner*—Carlton R. Croyle
*Assistant Examiner*—Donald E. Stout
*Attorney, Agent, or Firm*—Krass & Young

[57] ABSTRACT

Suction apparatus, particularly designed for handling liquid and semi-liquid materials in an industrial context, comprises a suction tank provided with simultaneously operable exhauster and discharge pumps each driven by a common compressed air source. The operational parameters of the pumps and the dimensions of conduits are such that during operation to raise a given liquid or semi-liquid the mean depression in the tank falls at least intermittently to a value at which the discharge pump can raise the contents of the tank. The arrangement enables continuous operation or suction to reclaim or handle liquid or semi-liquid material.

2 Claims, 3 Drawing Figures

INDUSTRIAL SUCTION APPARATUS

This application is a continuation of application Ser. No. 488,464, filed 4-25-83, now abandoned.

This invention relates to suction apparatus for reclaiming a slurry such as drilling mud.

In certain industries, the need arises to lift slurry-like materials, viscous liquids or semi-liquids and place them in a receptacle. In one such industry, costly and/or polluting drilling mud spilled on a deck surface presents such a need.

It has been proposed to raise liquids and semi-liquids by means of suction apparatus consisting essentially of a suction head for sweeping through the liquid or semi-liquid and connected by a flexible pipe to a suction tank. A disadvantage of prior proposals is that operation on suction can continue only so long as the capacity of the suction tank allows. When the tank has taken in its designed capacity, suction must cease and the tank be discharged by pressure or otherwise emptied. The disadvantage is not lessened by designing a relatively large capacity suction tank since a larger tank reduces the portability or stowability of the equipment, and increases cost.

Specifically, the suction apparatus according to the invention includes a tank having an inlet; conduit means communicating at one end thereof with the tank inlet; a sweeping head connected to the free end of the conduit means and adapted to engage the material; a vacuum pump arranged to evacuate air from the tank to create a vacuum condition within the tank and enable material to be conveyed from the sweeping head and through the conduit means into the tank through the tank inlet; a gas supply conduit adapted for connection to a supply of pressurized gas; a pressure gas operable motor connected to the gas supply conduit so as to be driven by the pressurized gas and drivingly connected to the vacuum pump; a diaphragm type discharge pump connected to the gas supply conduit so as to be driven by the pressurized gas and arranged to effect discharge of material from the tank; and intake valve means in the conduit means between the sweeping head and the tank inlet operative to selectively control the flow of material through the conduit means into the tank independently of the operation of the vacuum pump and of the discharge pump.

We have found that effective operation of the discharge pump simultaneously with suction operation to raise a liquid or semi-liquid such as a drilling mud into the tank is feasible provided that design parameters follow the following preferences, namely that the volumetric performance of the dishcarge pump, a positive displacement type of pump, should exceed the mean volumetric intake rate of the liquid or semi-liquid raised, the volumetric performance of the exhauster, the tank volume and the dimensions of conduits and conduit arrangements being such that during operation to raise a given liquid or semi-liquid the mean depression in the tank falls at least intermittently to a value at which the discharge pump can raise the contents of the tank.

An embodiment of the present invention will now be described, by way of example, with reference to the accompanying drawings in which.

Figure 1:
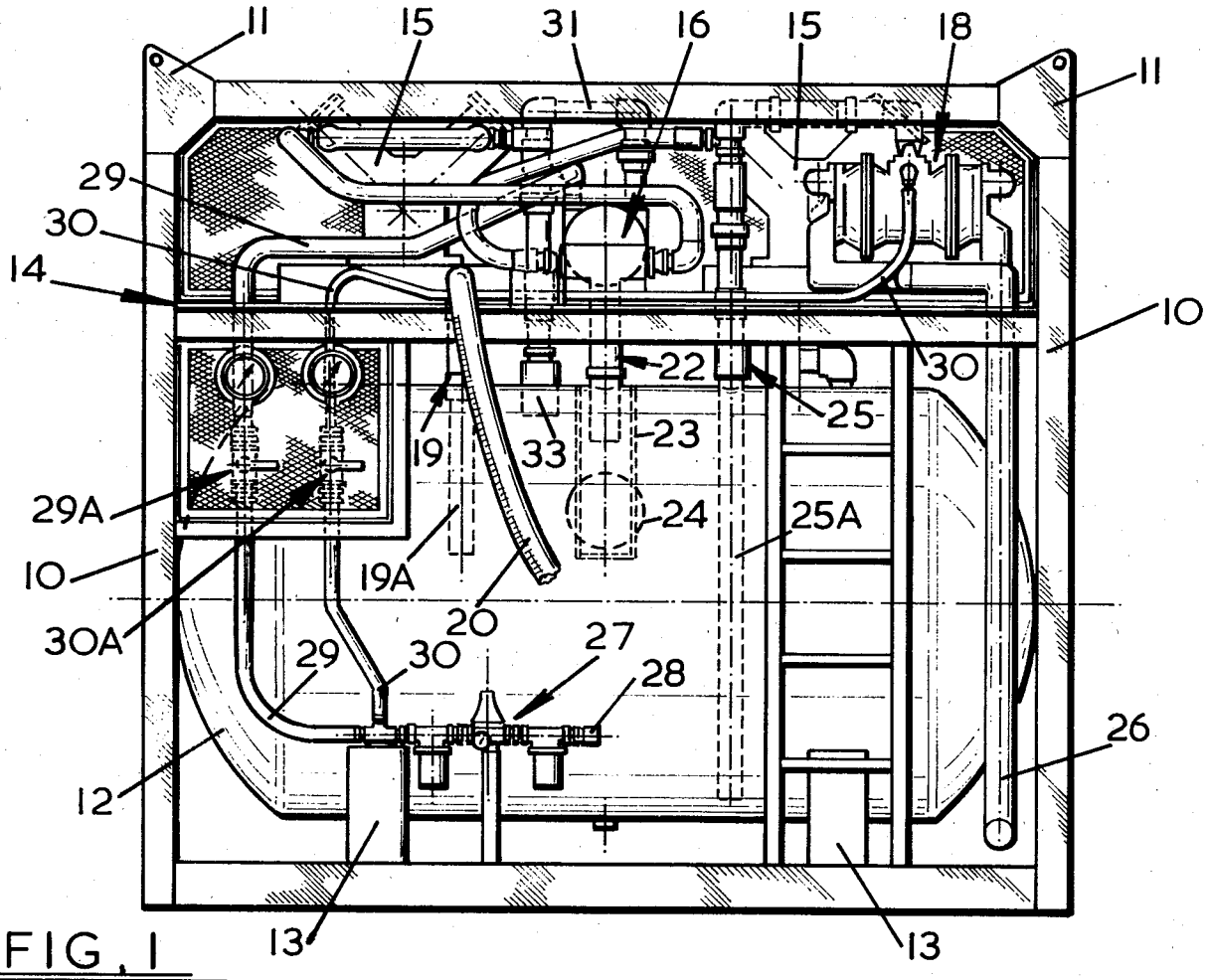
FIG. 1 is a front elevation of suction apparatus in accordance with the present invention.

In the drawings, an industrial suction apparatus for recovering drilling mud spilled on the surface of a platform deck consists of a framework or 'skid' 10 which is provided with lifting plates 11 at each corner for the attachment of crane slings. The lower portion of the skid 10 is occupied mainly by a suction tank 12 mounted on cradles 13 secured to the lower framework of the skid 10. The suction tank 12 is of conventional 'pressure vessel' configuration and has an overall length of 7 ft (213 cms) and an external diameter of 4 ft (122 cms).

Above the suction tank 12, the skid 10 is provided with a shelf 14 on which are mounted two exhausters or vacuum pumps 15, an air motor 16 arranged to drive the exhausters 15 through belt and pulley drives 17, and a compressed-air-operated double-diaphragm discharge pump 18.

More particularly, the suction tank 12 is provided with a suction inlet at 19 to which is connected a flexible pipe 20 for connection to a hand held suction head 20A. The suction pipe 20 is connected to the inlet 19 by way of a pilot operated normally closed valve 21 (see FIG. 3). The inlet 19 includes a downwards pipe extension 19A within the suction tank 12, the pipe 19A terminating at a level within the suction tank which is predetermined as the maximum liquid level within the tank.

Each of the exhausters 15 is connected by manifold piping to an exhauster connection 22 on the suction tank 12. The inner end of the connection 22 is constituted by an open pipe end within a cage 23 holding a ball float 24, the arrangement being such that, for example if the equipment is severely tilted, the ball float 24 will close the connection 22 in the event of liquid level within the suction tank 12 approaching the open pipe end of the connection. Thus, the ball float serves to prevent ingress of liquid to the pipe manifold system for the exhausters 15 which could be severely damaged by the liquid.

The discharge pump 18 is connected to an outlet 25 from the suction tank 12, the outlet 25 including a downwards pipe extension 25A which terminates adjacent the intended lowermost part or sump of the suction tank 12. The discharge pump 18 discharges into a pipe manifold connected to a common discharge pipe 26.

A filtering, regulating and lubricating unit 27 for compressed air is mounted on the skid 10 and has a common compressed air inlet connection 28. The compressed air outlet from the unit 27 divides into a larger bore supply pipe 29 which feeds the air motor 16 through a control valve 29A, and a smaller bore supply pipe 30 which feeds the discharge pump 18 through a separate control valve 30A. Thus, the exhausters 15 and the discharge pump 18 can be operated simultaneously or independently as required. The air exhausts from the air motor 16 and from the discharge pump 18 are taken via respective exhaust pipes 31 and 32 to a common air exhaust silencer 33.

Figure 3:
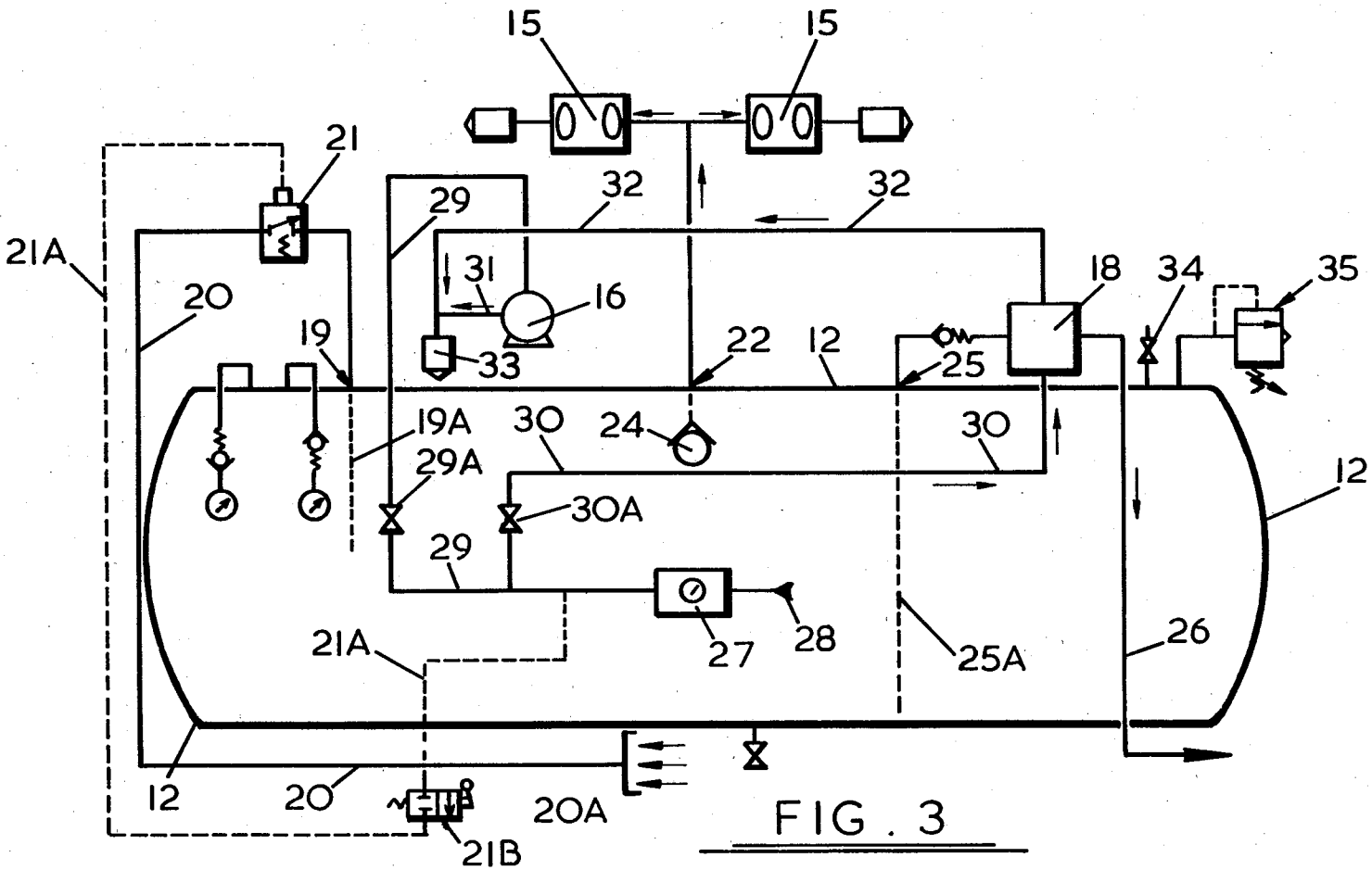
FIG. 3 is a schematic diagram of the apparatus illustrated in FIGS. 1 and 2.

As shown in FIG. 3, the suction tank is provided with a bleed valve 34 as a means of releasing vacuum within the tank, and also a pressure relief valve 35 provided as a safety precaution.

The pilot operated valve 21 is supplied with pilot air pressure through an auxiliary supply line 21A which is shown in FIG. 3 including a manual control valve 21B. In practice, the control valve 21B is mountd conveniently to the suction head 20A, and the supply line 21A would form a double run taped to the flexible hose 20.

Figure 2:
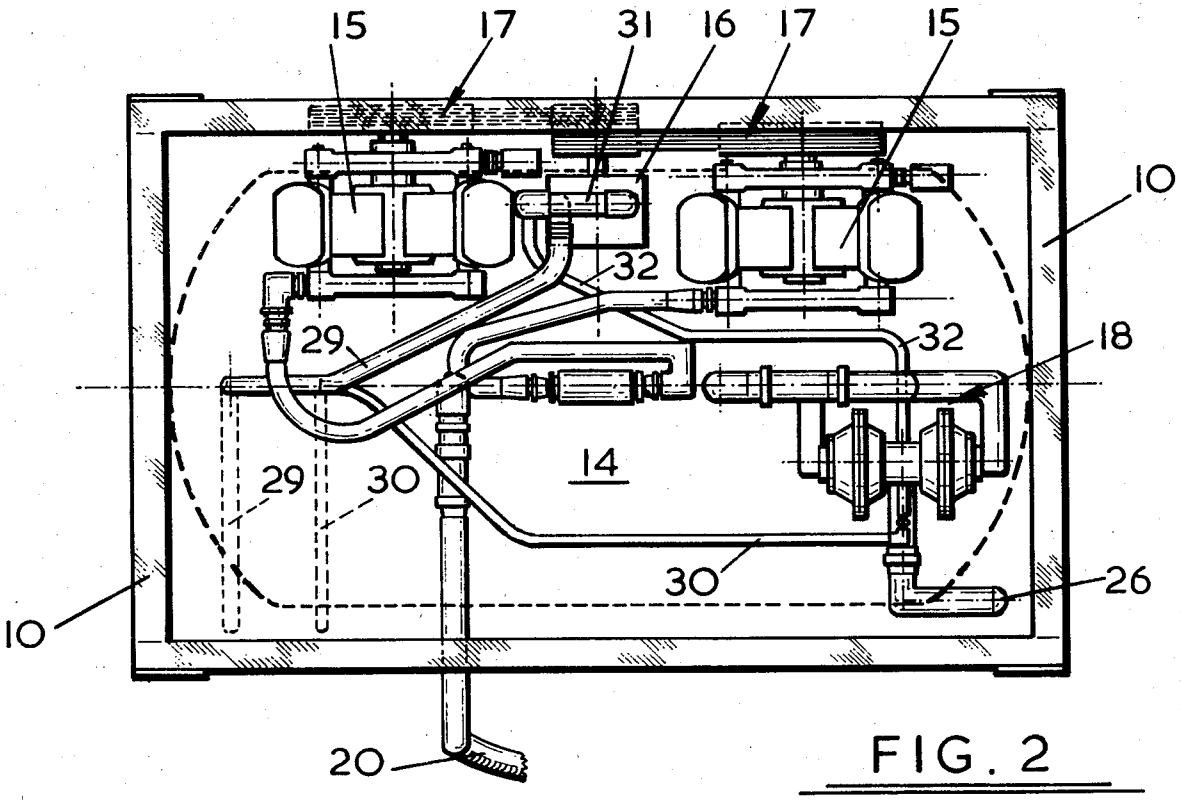
FIG. 2 is a plan view of the apparatus of FIG. 1.

Illustration of the pilot control system has been omitted in FIGS. 1 and 2 in the interests of clarity.

The suction inlet conduit and the discharge conduits are of pipes of 2" (5 cms) nominal diameter.

Operation of the apparatus is as follows. With a supply of compressed air connected to the compressed air inlet 28, the control valves 29A and 30A are both opened to effect simultaneous operation of the air motor 16 and the discharge pump 18. With the pilot operated valve 21 closed, a substantial depression will promptly be created within the suction tank 12. The intensity of the partial vacuum within the suction tank will somewhat more than cancel the ability of the discharge pump to raise a liquid or semi-liquid such as drilling mud. However, the discharge pump 18 will thereby sustain no damage and will either simply stall or idle. Operation of the control valve 21B and sweeping of the suction head 20A through drilling mud will cause the mud to be sucked through the suction pipe 20 and so transferred into the suction tank 12 through the suction inlet 19 and inlet pipe 19A. The intaken drilling mud will be entrained in an air flow and the air constituting such flow will enter the suction tank 12 and so tend to reduce the intensity of the partial vacuum therein. The design of the apparatus is such that such a tendency toards reduction of the partial vacuum leads to intermittent occurrences when the partial vacuum will have reduced to a value at which the discharge pump 18 can raise the drilling mud through the pipe 25A and discharge the mud through the pipe 26 into suitable containers for retention. Thus, reclaiming of the spilled drilling mud can proceed continuously simultaneously with discharge of the contents of the suction tank into storage containers. In the event that the intake to the suction tank 12 exceeds the discharge, the suction operation will cease when the level of drilling mud within the tank reaches the lower end of the suction pipe 19A. In this extreme event, the control valve 29A can be shut to cease operation of the exhausters 15, and if necessary the bleed valve 34 can be opened to admit air to the suction tank to permit continued operation of the discharge pump 18. Thus, the system is extremely flexible and capable of coping with extremes of conditions. Under most conditions, however, the system operates continuously on suction and intermittent discharge permitting a highly economic performance using apparatus which is simple to operate and virtually foolproof.

We claim:

1. Suction apparatus for reclaiming a slurry material such as drilling mud comprising:

a tank having an inlet;

conduit means communicating at one end thereof with said tank inlet;

a sweeping head connected to the free end of said conduit means and adapted to engage the slurry material;

a vacuum pump arranged to evacuate air from said tank to create a vacuum condition within said tank and enable slurry material to be conveyed from said sweeping head and through said conduit means into said tank through said tank inlet;

a gas supply conduit adapted for connection to a supply of pressurized gas;

a pressure gas operable motor connected to said gas supply conduit so as to be driven by said pressurized gas and drivingly connected to said vacuum pump;

a diaphragm type discharge pump connected to said gas supply conduit so as to be driven by said pressurized gas and arranged to effect discharge of slurry material from said tank; and intake valve means in said conduit means between said sweeping head and said tank inlet operative to selectively control the flow of slurry material through said conduit means into said tank independently of the operation of said vacuum pump and of said discharge pump.

2. Suction apparatus according to claim 1, including a connection within the tank and leading to the exhauster, a cage surrounding the connection, a float valve element in the cage and adapted and arranged for closing the connection to the exhauster.

* * * * *